US011774054B1

(12) United States Patent
Zhu

(10) Patent No.: US 11,774,054 B1
(45) Date of Patent: Oct. 3, 2023

(54) DOWNLIGHT

(71) Applicant: Lili Zhu, Taizhou (CN)

(72) Inventor: Lili Zhu, Taizhou (CN)

(73) Assignee: Taizhou JiaoGuang Lighting Co., Ltd., Taizhou (CN)

( * ) Notice: Subject to any disclaimer, the term of this patent is extended or adjusted under 35 U.S.C. 154(b) by 0 days.

(21) Appl. No.: 18/106,502

(22) Filed: Feb. 7, 2023

(30) Foreign Application Priority Data

Oct. 31, 2022 (CN) ..... 202211342336.7

(51) Int. Cl.

| | |
|---|---|
| ***F21V 21/04*** | (2006.01) |
| ***F21S 8/02*** | (2006.01) |
| ***F21V 23/06*** | (2006.01) |
| ***F21V 17/14*** | (2006.01) |

(52) U.S. Cl.
CPC ..... *F21S 8/026* (2013.01); *F21V 17/14* (2013.01); *F21V 23/06* (2013.01)

(58) Field of Classification Search
None
See application file for complete search history.

(56) References Cited

U.S. PATENT DOCUMENTS

2012/0051068 A1* 3/2012 Pelton ..... F21V 19/0035 362/373
2017/0234514 A1* 8/2017 Hildebrand ..... F21V 21/047 362/365
2019/0056098 A1* 2/2019 Blake ..... F21V 5/04

* cited by examiner

*Primary Examiner* — Elmito Breval
(74) *Attorney, Agent, or Firm* — Minder Law Group; Willy H. Wong

(57) ABSTRACT

The present invention provides a downlight, which pertains to the technical field of lighting equipment. The present downlight comprises a downlight housing, an aluminum substrate module and a transparent cover. The transparent cover has a plurality of bayonet-coupling protrusions protruding vertically, the downlight housing has a horizontal ring-shaped support wall, the support wall is provided thereon with bayonet-coupling slots in one-to-one correspondence with the bayonet-coupling protrusions, each of the bayonet-coupling slots comprises circumferentially arranged a wide slot segment and a narrow slot segment, and each of the bayonet-coupling protrusions is capable of inserting vertically into the wide slot segment of one of the corresponding bayonet-coupling slots and sliding circumferentially along the one of the corresponding bayonet-coupling slots to the narrow slot segment where the bayonet-coupling protrusion abuts with its lower end surface against the support wall. The present downlight is convenient to install and disassemble while ensuring good heat dissipation.

11 Claims, 13 Drawing Sheets

DOWNLIGHT

RELATED APPLICATIONS

This application claims priority to Chinese Patent Application No. CN202211342336.7 filed Oct. 31, 2022.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention pertains to the technical field of lighting equipment, and relates to a downlight.

BACKGROUND

As nowadays decoration styles are becoming more and more diverse, there is also a growing demand for downlights. A downlight in the prior art generally has a screw head that can be directly fitted with an incandescent bulb or an energy-saving bulb. In house decoration, downlights can be embedded in ceiling, giving good concealment and enhancing utilization of house space. Downlights after long time use may also get damaged, and damage often occurs to a light source assembly on an aluminum substrate module. As typically downlight is embedded entirely in ceiling, and existing downlights are usually of an integral design, a damaged downlight has to be replaced entirely, resulting in a high replacement cost.

In view of the above defects, a variety of downlights have been developed. For example, a split-type downlight is disclosed in Chinese patent application [Publication No.: CN205640561U], which comprises a downlight housing, an inner container, a power supply board, and an aluminum substrate, with the downlight housing and the inner container both being cylindrical structures. The downlight housing is provided with two or more lugs evenly distributed along a circumference of the downlight housing, the lugs being fixed to the downlight housing by rivets or screws. The downlight housing has a plurality of recesses, and the inner container has a plurality of protruding snap members matching the recesses, thus the inner container can be embedded and fixed in the downlight housing by embedding the protruding snap members into the recesses. An inner surface of the inner container is provided with a plurality of rubber columns or screw holes, and a surface of the power supply board is provided with a plurality of matching holes, so that the power supply board can be connected to the inner container by means of the matching rubber columns and holes, or by using screws. An inner lateral surface of the inner container is provided with a plurality of elastic snap members distributed at equal intervals along the circumference, so that the aluminum substrate can be connected to the inner container by means of the elastic snap members. A transparent cover is connected with the lower end of the inner container. The inner container further has a plurality of concave or convex snap members evenly distributed on an inner lateral surface at a lower end of the inner container, and the transparent cover has a plurality of convex or concave snap members evenly distributed on a lateral surface of the transparent cover, the positions of the concave and convex snap members being matched, thus the transparent cover can be connected to the lower end of the inner container by means of the concave and convex snap members. Furthermore, the inner container is provided with a plurality of elongated air ventilation holes evenly distributed on its upper surface.

According to the above structure, a user needs to remove the transparent cover first, then remove the aluminum substrate, and then replace the aluminum substrate or repair a light source assembly on the aluminum substrate to realize maintenance of the downlight and replacement of its parts. However, in such a structure, the concave and convex snap members connecting the transparent cover to the inner container are located inside the inner container, confining space of operation and making operation inconvenient; on the other hand, the concave and convex snap members undergo certain deformation during installation and disassembly in order to realize engagement and disengagement, requiring a relatively large force for installation and disassembly, making installation and disassembly difficult, and, after several times of maintenance and replacement, the concave and convex snap members are prone to insufficient elasticity or fracture, affecting service life of the connection parts of the downlight; moreover, the air ventilation holes directly formed on the upper surface of the inner container will reduce the structural strength of the inner container, leading to the need of improving the structure of the inner container and resulting in complex formation of the inner container.

SUMMARY

Some objectives of one embodiment of the present invention are to provide a downlight with respect to the above defects in the prior art, to solve the technical problem on how to make installation and disassembly of the downlight convenient and easy in maintenance while ensuring good heat dissipation.

The objectives of the present invention can be achieved by the following technical solution.

A downlight comprises: a downlight housing with a downward-facing opening, an aluminum substrate module disposed inside the downlight housing and detachably connected to a top wall of the downlight housing, and a transparent cover disposed at the opening inside the downlight housing and below the aluminum substrate module. The transparent cover has a plurality of bayonet-coupling protrusions protruding vertically, the downlight housing has a horizontal ring-shaped support wall at a middle part of the downlight housing, the support wall is provided thereon with bayonet-coupling slots in one-to-one correspondence with the bayonet-coupling protrusions, each of the bayonet-coupling slots comprises circumferentially arranged a wide slot segment and a narrow slot segment, the wide slot segment and the narrow slot segment having a width along a radial direction of the support wall, the width of the wide slot segment being wider than the width of the narrow slot segment, and each of the bayonet-coupling protrusions is capable of inserting vertically into the wide slot segment of one of the corresponding bayonet-coupling slots and sliding circumferentially along one of the corresponding bayonet-coupling slots to the narrow slot segment where the bayonet-coupling protrusion abuts with its lateral lower surface against the support wall.

Installation principle: Firstly, connect the aluminum substrate module to the top wall of the downlight housing, then vertically and upwardly insert the bayonet-coupling protrusions of the transparent cover into the wide slot segments of the corresponding bayonet-coupling slots respectively, next, rotate the transparent cover so that the bayonet-coupling protrusions slide from the wide slot segments into the narrow slot segments of the bayonet-coupling slots respectively, where a lower side of each of the bayonet-coupling protrusions abuts against the horizontal support wall, thus connecting the transparent cover inside the downlight housing, realizing installation of the transparent cover and covering the opening of the downlight housing. Therefore, installation of the downlight is convenient and easy. With an embedded setting of the bayonet-coupling protrusions in the bayonet-coupling slots, no deformation is incurred in the connection between the transparent cover and the downlight housing, making the connection parts of the transparent cover and the downlight housing less likely to be damaged after long-time use of the downlight, thus enhancing service life of the connection between the transparent cover and the downlight housing; further, once the bayonet-coupling protrusions are slid into the narrow slot segments, a communication is established between an inner side of the downlight housing and the outside via the wide slot segments of the bayonet-coupling slots, thus the bayonet-coupling slots not only serve as connection parts, but also provide heat dissipation. Disassembly principle: when the downlight is in need of maintenance, a user simply needs to disassemble the transparent cover first, that is, the user directly turns the transparent cover reversely to slide the bayonet-coupling protrusions back to the wide slot segments of the bayonet-coupling slots respectively, then pulls out the transparent cover downward to uncover the opening of the downlight housing, and then the aluminum substrate module can be disassembled from the top wall of the downlight housing and moved out of the downlight housing from the opening, thus realizing maintenance and replacement of the aluminum substrate module, making replacement of the aluminum substrate module more convenient and quick. Therefore, the present downlight is convenient and easy to install and disassemble while guaranteeing good heat dissipation.

In one embodiment of the above downlight, each of the bayonet-coupling protrusions comprises a sliding portion capable of sliding in one of the bayonet-coupling slots and a horizontal limit portion capable of abutting against the support wall, the limit portion has a lower end surface comprising an upwardly inclined avoidance surface and a limit surface capable of abutting against the support wall, with the limit surface being jointed to a lower end of the avoidance surface, and a heat-dissipation gap is formed between the avoidance surface and the support wall when the limit surface abuts against the support wall.

The sliding portion slides along the bayonet-coupling slot until the limit surface on the limit portion abuts against the support wall, realizing connection between the transparent cover and the downlight housing. Besides, by providing the upwardly inclined avoidance surface, on the one hand, the heat dissipation gap formed between the avoidance surface and the support wall gives better heat dissipation of the downlight, and on the other hand, it contributes to reducing the area of the limit surface of the bayonet-coupling protrusion, thus lowering machining precision requirement on the limit surface; in addition, the avoidance surface can also act as a guide, such that the sliding portion of the bayonet-coupling protrusion can quickly and steadily slide into the narrow slot segment, thereby further enhancing the convenience and ease of installation of the transparent cover.

In one embodiment of the above downlight, a slot wall of each of the bayonet-coupling slots has a guide surface connecting a slot wall of the wide slot segment and a slot wall of the narrow slot segment, and the guide surface is formed to be angled inward from its one end away from the narrow slot segment to the other end near the narrow slot segment; alternatively, the guide surface is convex-inwardly curved.

The guide surface can guide the bayonet-coupling protrusion so that the bayonet-coupling protrusion can be quickly and steadily embedded into the narrow slot segment, further enhancing the convenience and ease of installation and disassembly of the transparent cover.

The guiding surface, whether it is an inclined plane or a curved surface, can provide a guiding effect.

In one embodiment of the above downlight, the transparent cover comprises a curved cover body, an shoulder extending on an outer edge of the cover body and capable of abutting against the downlight housing, a heat sink rim formed by vertical projection of the cover body and opposite a lateral inner side of the support wall, and the bayonet-coupling protrusions provided at an upper end of the heat sink rim, a heat-dissipation space is enclosed and formed by the heat sink rim, the shoulder and the downlight housing together and communicatively connected with all the bayonet-coupling slots.

The heat dissipation space also functions as an airflow channel to outside, allowing air between the transparent cover and the downlight housing to flow to outside, thus enhancing heat dissipation effect of the downlight. The shoulder can abut against the downlight housing, so the shoulder serves as a stopper when mounting the transparent cover, making installation of the transparent cover convenient and easy.

In one embodiment of the above downlight, the heat sink rim is ring-shaped so that a working space is enclosed and formed by the cover body, the heat sink rim and the downlight housing together and separated from the heat-dissipation space by the heat sink rim.

With the heat sink rim, the heat dissipation space is separated from the working space, avoiding affecting the working space and preventing external dust and other debris from entering the working space and affecting the lighting effect of the downlight, thus ensuring relative enclosure of the working space while giving good heat dissipation for the downlight.

In one embodiment of the above downlight, the shoulder is ring-shaped and provided on its outer side with a bevel face that slopes outward in an up-to-down direction.

In one embodiment of the above downlight, an inner transparent cover covering the aluminum substrate module is further connected to the top wall of the downlight housing, both the inner transparent cover and the aluminum substrate module are provided with a plurality of elongated mounting holes, the mounting holes of the inner transparent cover are exactly opposite to the mounting holes of the aluminum substrate module, each of the mounting holes comprises circumferentially arranged a large aperture segment and a small aperture segment, the large aperture segment having an aperture diameter larger than that of the small aperture segment, the downlight further comprises a plurality of fasteners, each of the fasteners comprises a head capable of passing through the corresponding large aperture segment and a shank capable of inserting into the corresponding small aperture segment, the head of each of the fasteners press the inner transparent cover and the aluminum substrate module tightly against the top wall of the downlight housing so as to attach both the inner transparent cover and the aluminum substrate module to the downlight housing.

Using the inner transparent cover to shield the aluminum substrate module prevents external dust from affecting the brightness of the light source assembly in the aluminum substrate module. With the mounting holes, it is convenient to mount/remove the inner transparent cover and the aluminum substrate module to/from the top wall of the downlight housing. When mounting the inner transparent cover and the aluminum substrate module, the fasteners do not have to be removed but can remain fixed on the top wall of the downlight housing, and a user simply needs to align the large aperture segments of the mounting holes with the heads of the fasteners respectively, then push the inner transparent cover and the aluminum substrate module upward to let the heads of the fasteners pass through the large aperture segments of the mounting holes respectively, and then rotate the inner transparent cover and the aluminum substrate module to cause the large aperture segments of the mounting holes to slide away from the fasteners while the small aperture segments are slid to align with the heads of the fasteners, thus the heads of the fasteners press the inner transparent cover and the aluminum substrate module tightly against the top wall of the downlight housing. When removing the aluminum substrate module, the fasteners can still remain fixed on the top wall of the downlight housing, and the user simply needs to rotate the inner transparent cover and the aluminum substrate module relative to the fasteners to cause the small aperture segments to slide away from the fasteners while the large aperture segments align with the fasteners, so that the inner transparent cover and the aluminum substrate module are free from pressing of the heads of the fasteners and thus can be downwardly pulled out. In this way, the inner transparent cover and the aluminum substrate module can be directly removed from the downlight housing without removing the fasteners, that is, simply by rotating the inner transparent cover and the aluminum substrate module and then pulling them out downwardly. Therefore, when it is not convenient for a user to remove the fasteners, he can directly rotate the inner transparent cover and the aluminum substrate module to remove them for replacement or maintenance, thereby preventing the fasteners from accidentally lost after removal and further enhancing maintenance convenience of the downlight.

In one embodiment of the above downlight, an inner transparent cover covering the aluminum substrate module is further connected to the top wall of the downlight housing, and, by means of fasteners, the inner transparent cover presses the aluminum substrate module tightly against the top wall of the downlight housing thus attaching the aluminum substrate module to the downlight housing.

Using the inner transparent cover to shield the aluminum substrate module prevents external dust from affecting the brightness of the light source assembly in the aluminum substrate module; using the fasteners to press the aluminum substrate module tightly to the top wall of the downlight housing, so when the aluminum substrate module is required to be removed, only the fasteners need to be removed in order to take out both the inner transparent cover and the aluminum substrate module for replacement and maintenance of the aluminum substrate module. In this way, it realizes convenient maintenance or replacement of the aluminum substrate module while ensuring proper use of the aluminum substrate module.

In one embodiment of the above downlight, a bottom of the inner transparent cover has inwardly recessed mounting notches which are in one-to-one correspondence with the fasteners, and the head of each of the fasteners is provided in one of the corresponding mounting notches, respectively.

The mounting notches make the fasteners easy to install and access, further enhancing efficiency of installation and disassembly of the inner transparent cover and the aluminum substrate module.

In one embodiment of the above downlight, the aluminum substrate module is provided thereon with a light source assembly and a male adapter electrically connected to the light source assembly via a wire, the downlight housing is connected with a connection base provided on a top of the downlight housing, the connection base has an electrically connected power cord to which a female adapter is connected, the female adapter being capable of connecting to the male adapter in a plug-in manner.

With the matching male and female adapters, the aluminum substrate module does not need additional connection parts, making the structure of the downlight simpler and further enhancing efficiency of installation and disassembly of the downlight.

Compared to the prior art, the present downlight has the following advantages:

1. With an embedded setting of the bayonet-coupling protrusions in the bayonet-coupling slots, no deformation is incurred in the connection between the transparent cover and the downlight housing, making the structures of the bayonet-coupling slots and the bayonet-coupling slots less likely to be damaged after long-time use of the downlight, thus enhancing service life of the connection between the transparent cover and the downlight housing; further, once the bayonet-coupling protrusions are slid into the narrow slot segments, a communication is established between an inner side of the transparent cover and the outside via the bayonet-coupling slots, therefore, the bayonet-coupling slots not only serve as connection parts, but also provide heat dissipation.
2. With the heat sink rim and the shoulder, a heat dissipation space enclosed and formed by them along with the downlight housing is communicatively connected with all the bayonet-coupling slots and functions as an airflow channel to outside, allowing air between the transparent cover and the downlight housing to flow to outside, thus enhancing heat dissipation effect of the downlight.

DETAILED DESCRIPTION

Figure 1:
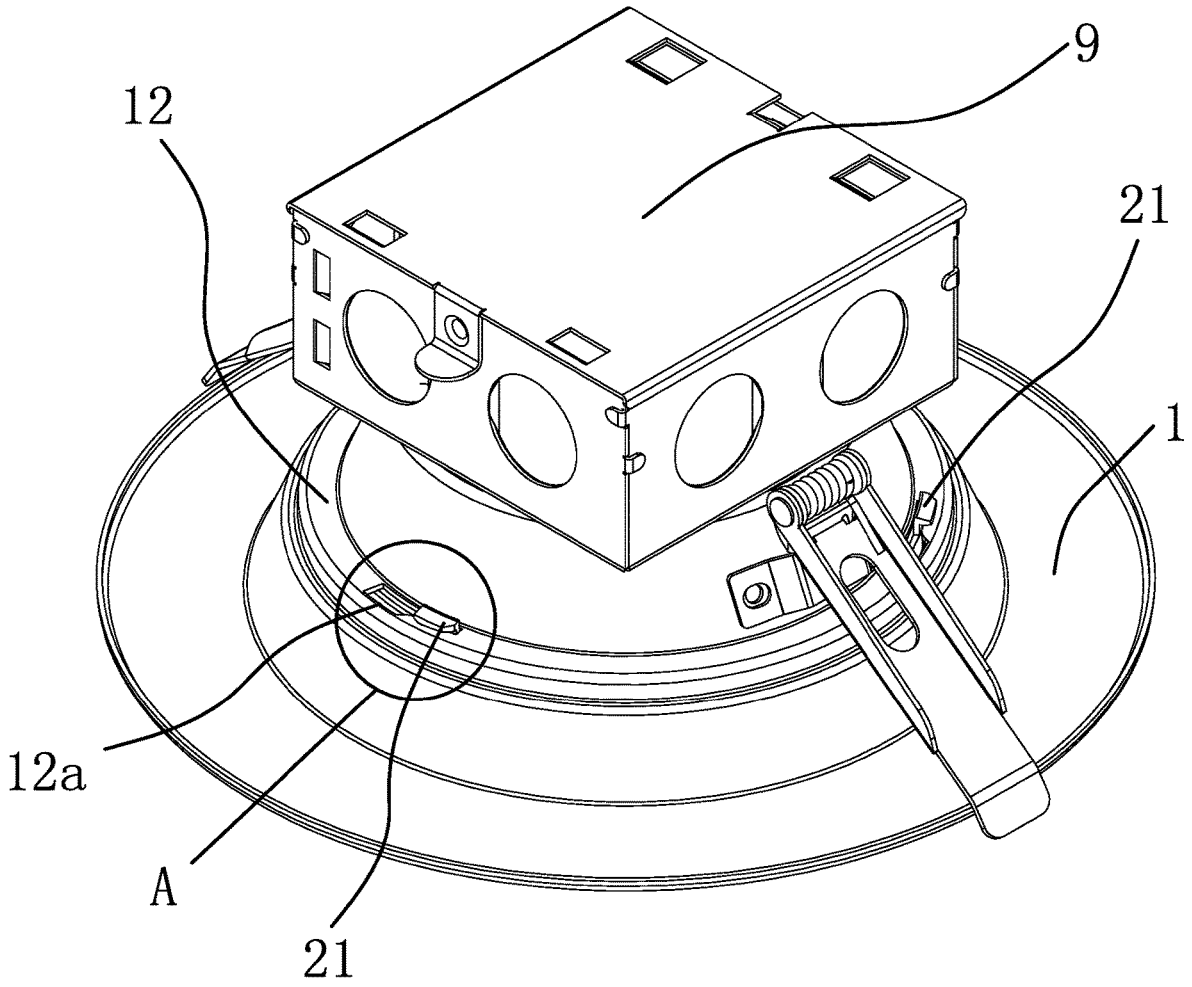
FIG. 1 is a perspective view of the downlight of the present invention.
Figure 2:
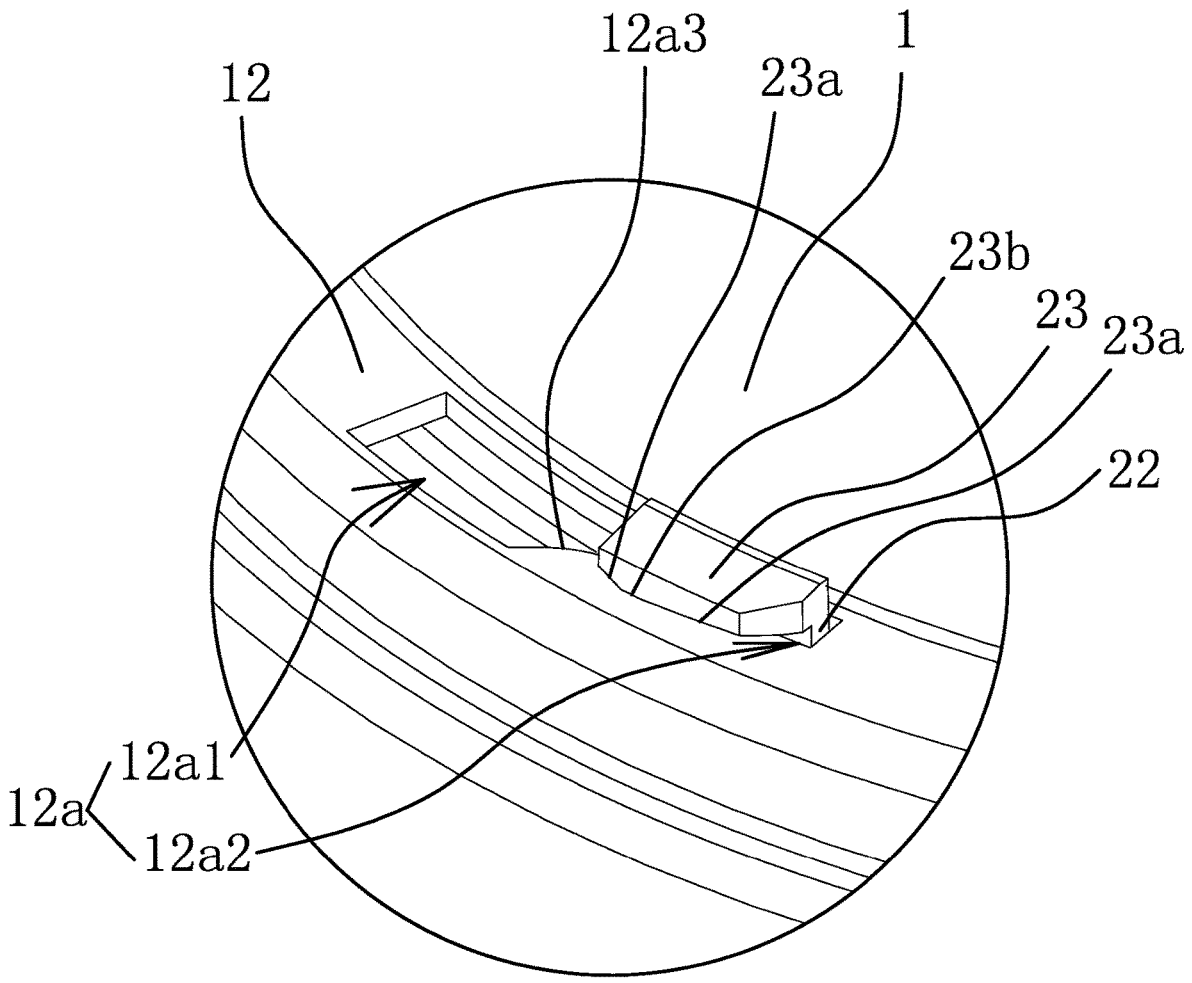
FIG. 2 is an enlarged partial view of an area A in FIG. 1.
Figure 3:
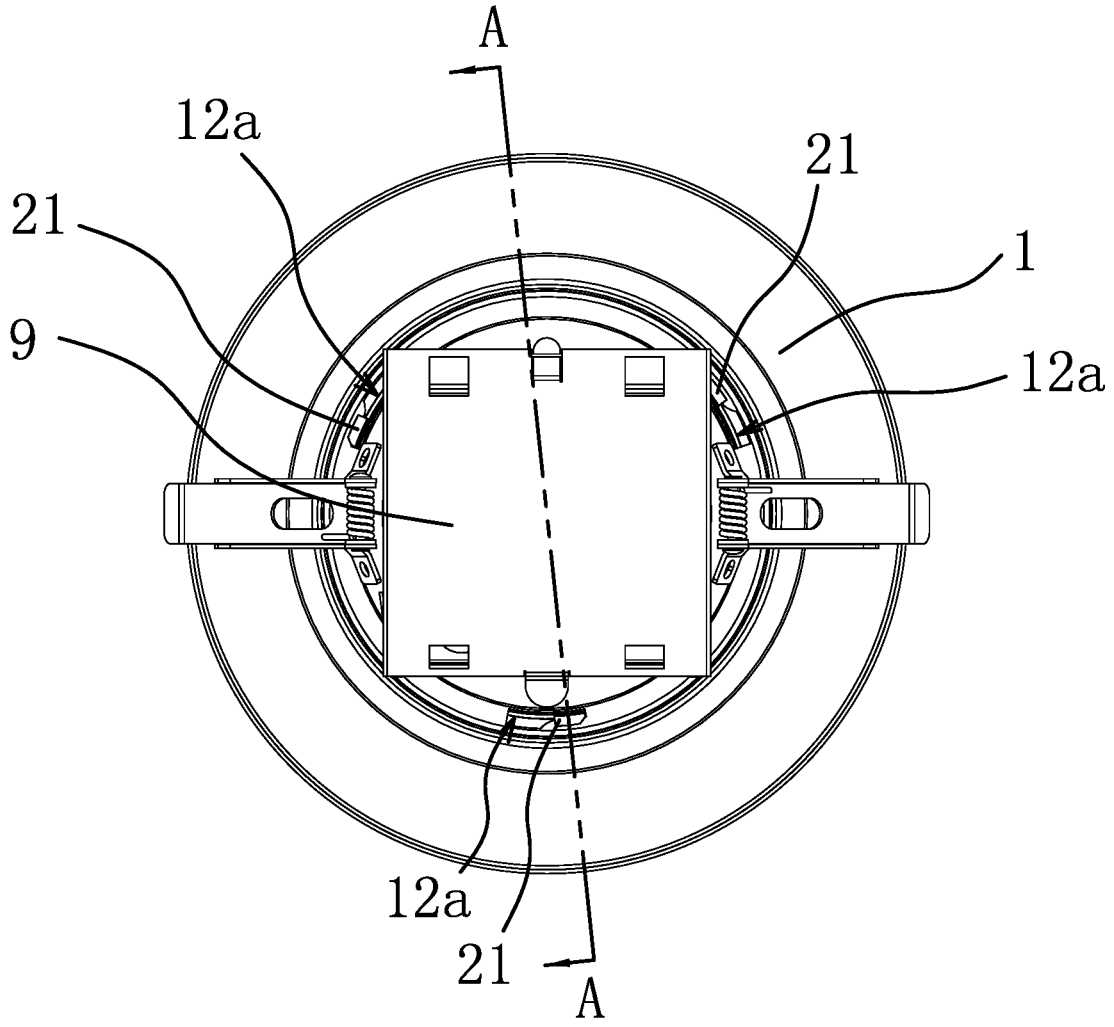
FIG. 3 is a top view of the downlight of the present invention.
Figure 4:
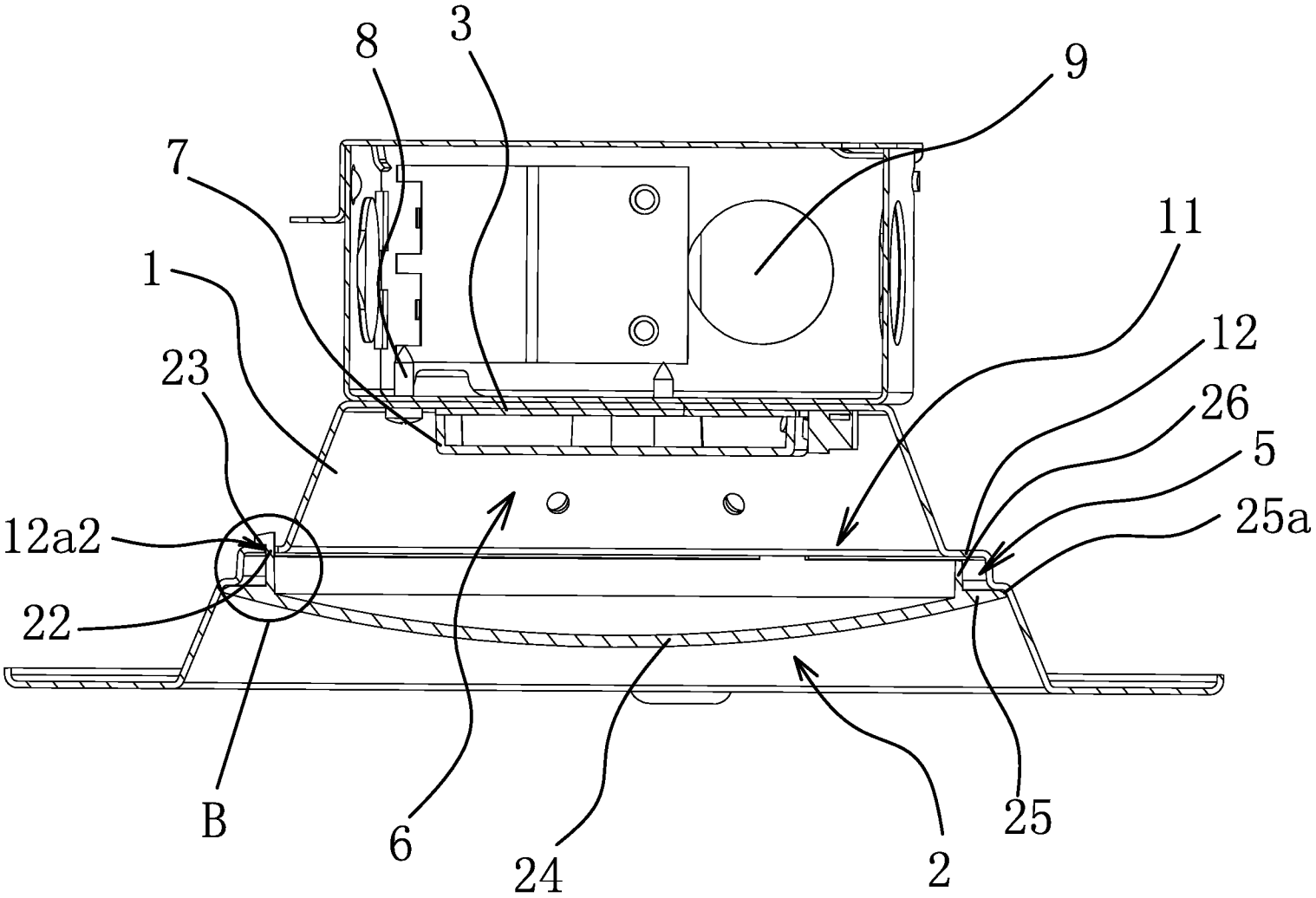
FIG. 4 is a cross-sectional partial view along line A-A in FIG. 3.
Figure 5:
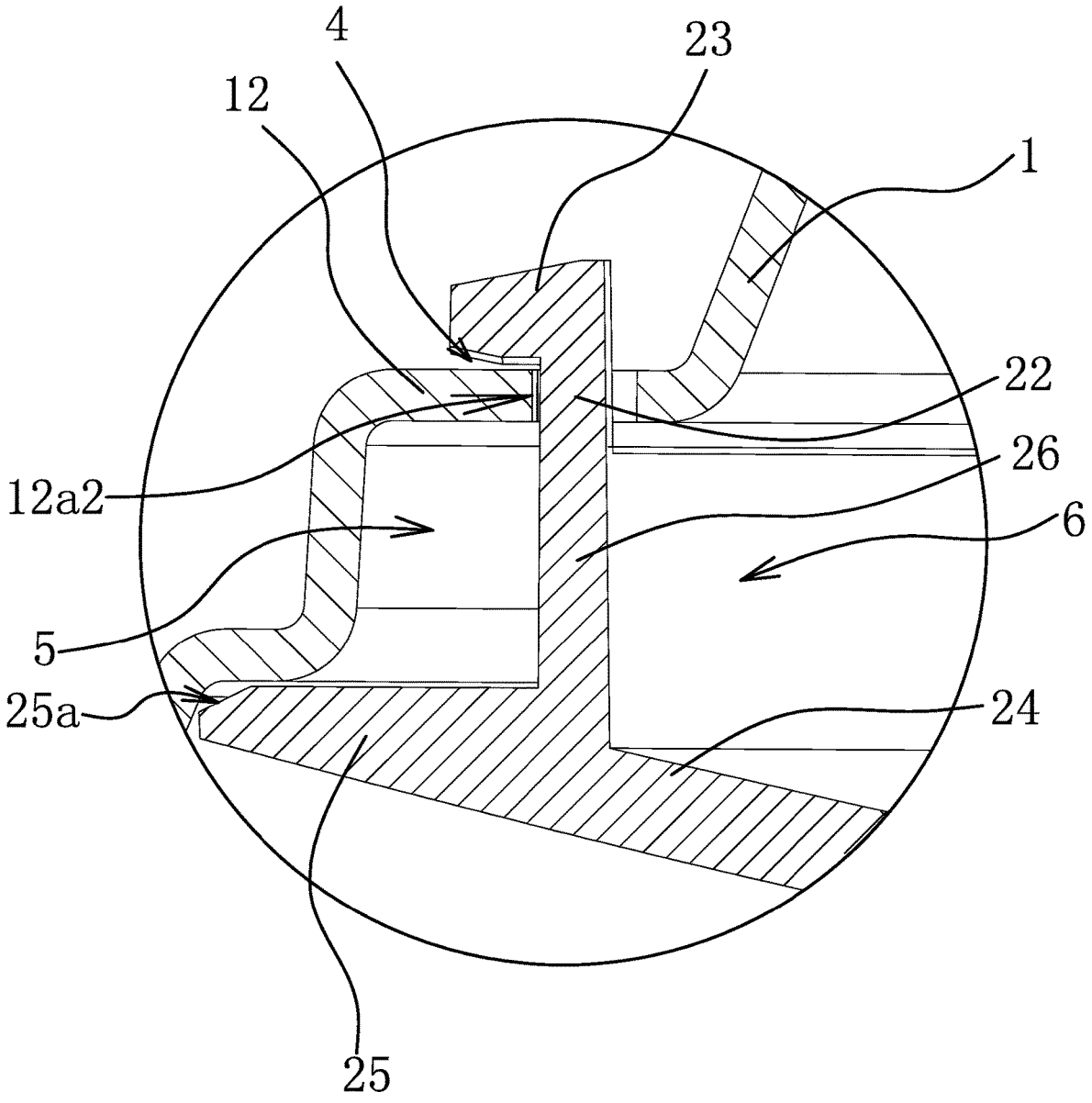
FIG. 5 is an enlarged partial view of an area B in FIG. 4.

Set forth below are specific embodiments of the present invention and a further description of the technical solutions of the present invention in conjunction with the accompanying drawings, but the present invention is not limited to these embodiments.

Embodiment I

As shown in FIGS. 1-4, the present downlight comprises: a downlight housing 1 with a downward-facing opening 11; an aluminum substrate module 3 disposed inside the downlight housing 1 and detachably connected to a top wall of the downlight housing 1; and, a transparent cover 2 disposed at the opening 11 inside the downlight housing 1 and below the aluminum substrate module 3.

Specifically, as shown in FIGS. 1-7, 9, and 10, the transparent cover 2 has a plurality of bayonet-coupling protrusions 21 protruding vertically. The downlight housing 1 has a horizontal ring-shaped support wall 12 at a middle part of the downlight housing 1, and the support wall 12 is provided thereon with bayonet-coupling slots 12*a* in one-to-one correspondence with the bayonet-coupling protrusions 21. Each of the bayonet-coupling protrusions 21 comprises a sliding portion 22 capable of sliding in one of the bayonet-coupling slots 12*a* and a horizontal limit portion 23 capable of abutting against the support wall 12. The limit portion 23 has a lower end surface comprising an upwardly inclined avoidance surface 23*a* and a limit surface 23*b* capable of abutting against the support wall 12, with the limit surface 23*b* being jointed to a lower end of the avoidance surface 23*a*. Each of the bayonet-coupling slots 12*a* is curved and comprises circumferentially arranged a wide slot segment 12*a*1 and a narrow slot segment 12*a*2, the wide slot segment 12*a*1 and the narrow slot segment 12*a*2 having a width along a radial direction of the support wall 12, the width of the wide slot segment 12*a*1 being wider than the width of the narrow slot segment 12*a*2. Each of the bayonet-coupling protrusions 21 is capable of inserting vertically into the wide slot segment 12*a*1 of one of the corresponding bayonet-coupling slots 12*a* and sliding circumferentially along one of the corresponding bayonet-coupling slots 12*a* to the narrow slot segment 12*a*2 where the bayonet-coupling protrusion 21 abuts with its limit surface 23*b* against the support wall 12 and at the same time a heat-dissipation gap 4 is formed between the avoidance surface 23*a* and the support wall 12. The avoidance surface 23*a* is provided as two discrete facets, each being at either end of the limit surface 23*b* and both being jointed to the limit surface 23*b* and upwardly inclined from its one end near the limit surface 23*b* to the other end away from the limit surface 23*b*. Such setting of the avoidance surface 23*a* allows the bayonet-coupling protrusions 21 to be quickly brought into place and also quickly released from the bayonet-coupling slots 12*a*, making it convenient to install and disassemble the downlight. A slot wall of each of the bayonet-coupling slots 12*a* has a guide surface 12*a*3 connecting a slot wall of the wide slot segment 12*a*1 and a slot wall of the narrow slot segment 12*a*2, and the guide surface 12*a*3 is convex-inwardly curved.

As shown in FIGS. 2, 3, 4, 9, and 10, the transparent cover 2 comprises a convex-downwardly curved cover body 24, a ring-shaped shoulder 25 extending on an outer edge of the cover body 24 and capable of abutting against the downlight housing 1, a ring-shaped heat sink rim 26 formed by vertical projection of the cover body 24 from an upper surface of the cover body 24 and opposite a lateral inner side of the support wall 12, and the bayonet-coupling protrusions 21 provided at an upper end of the heat sink rim 26. A heat-dissipation space 5 is enclosed and formed by the heat sink rim 26, the shoulder 25 and the downlight housing 1 together and communicatively connected with all the bayonet-coupling slots 12*a*. A working space 6 is enclosed and formed by the cover body 24, the heat sink rim 26 and the downlight housing 1 together and separated from the heat-dissipation space 5 by the heat sink rim 26. The shoulder 25 is provided on its outer side with a bevel face 25*a* that slopes outward in an up-to-down direction. The bevel face 25*a* has an anti-interference effect which ensures smooth assembly of the transparent cover 24 into the downlight housing 1.

Figure 6:
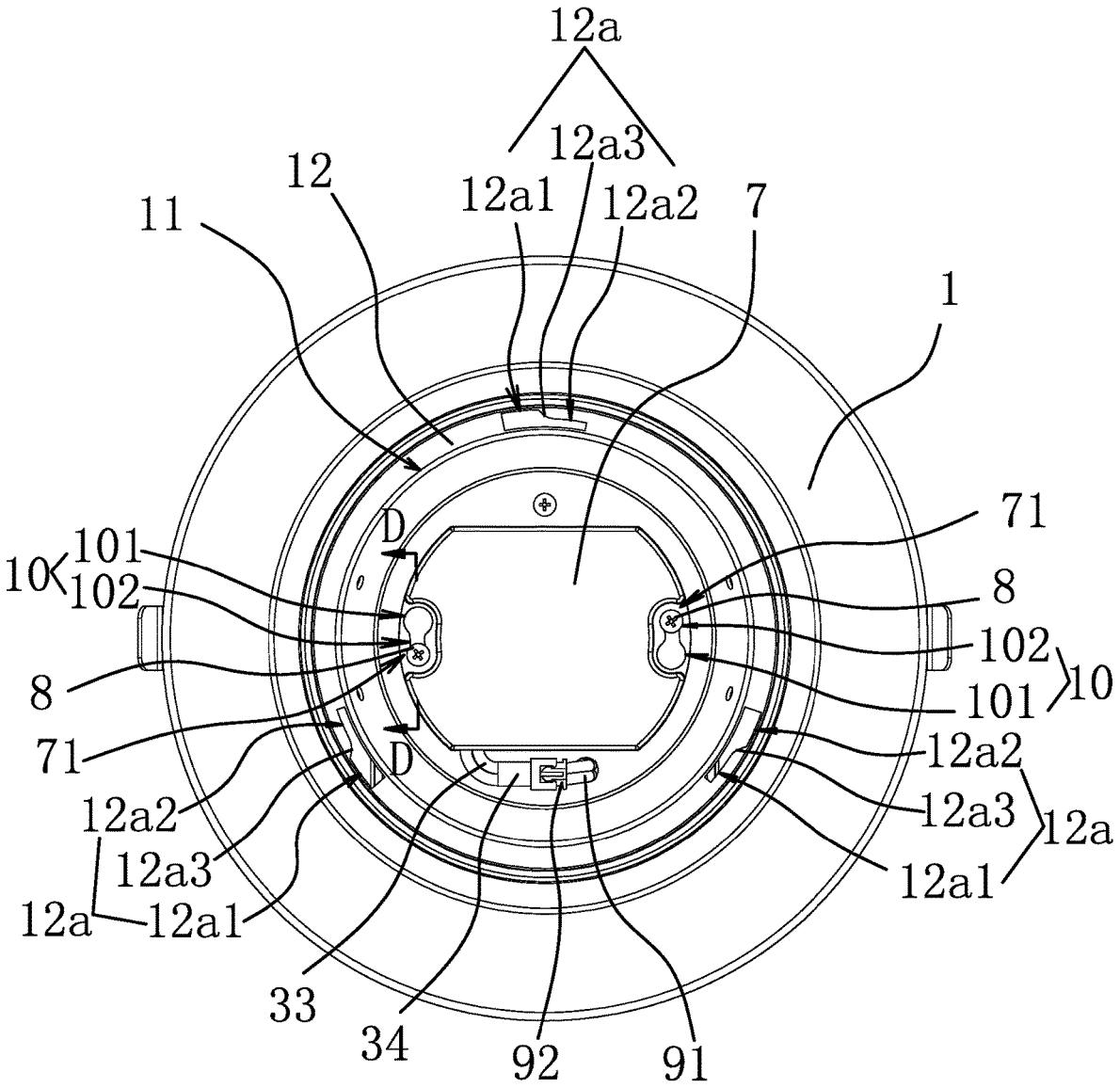
FIG. 6 is a bottom view of Embodiment I of the present invention, with the transparent cover removed.
Figure 7:
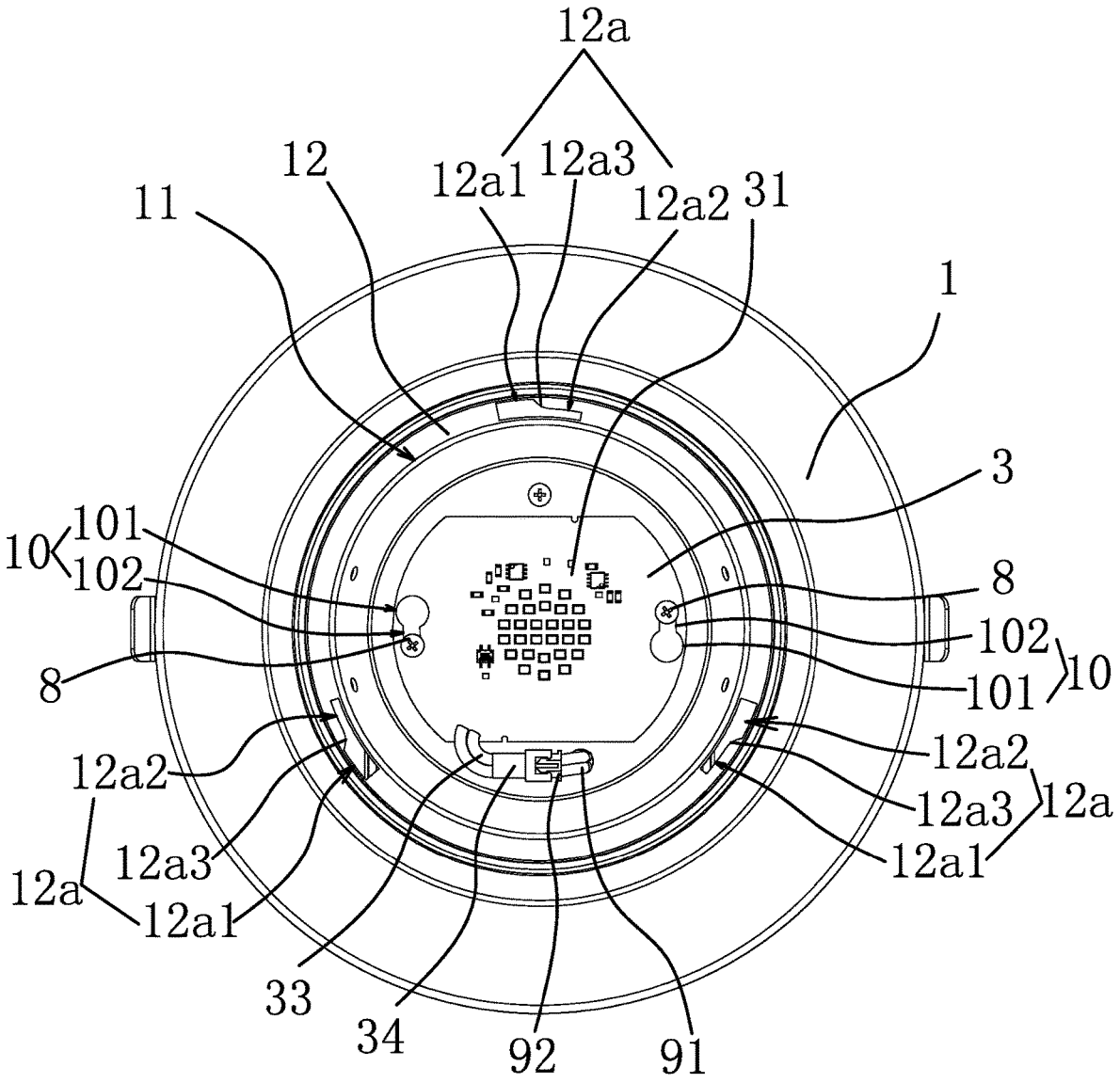
FIG. 7 is a bottom view of Embodiment I of the present invention, where the transparent cover is removed and the inner transparent cover is hidden.
Figure 8:
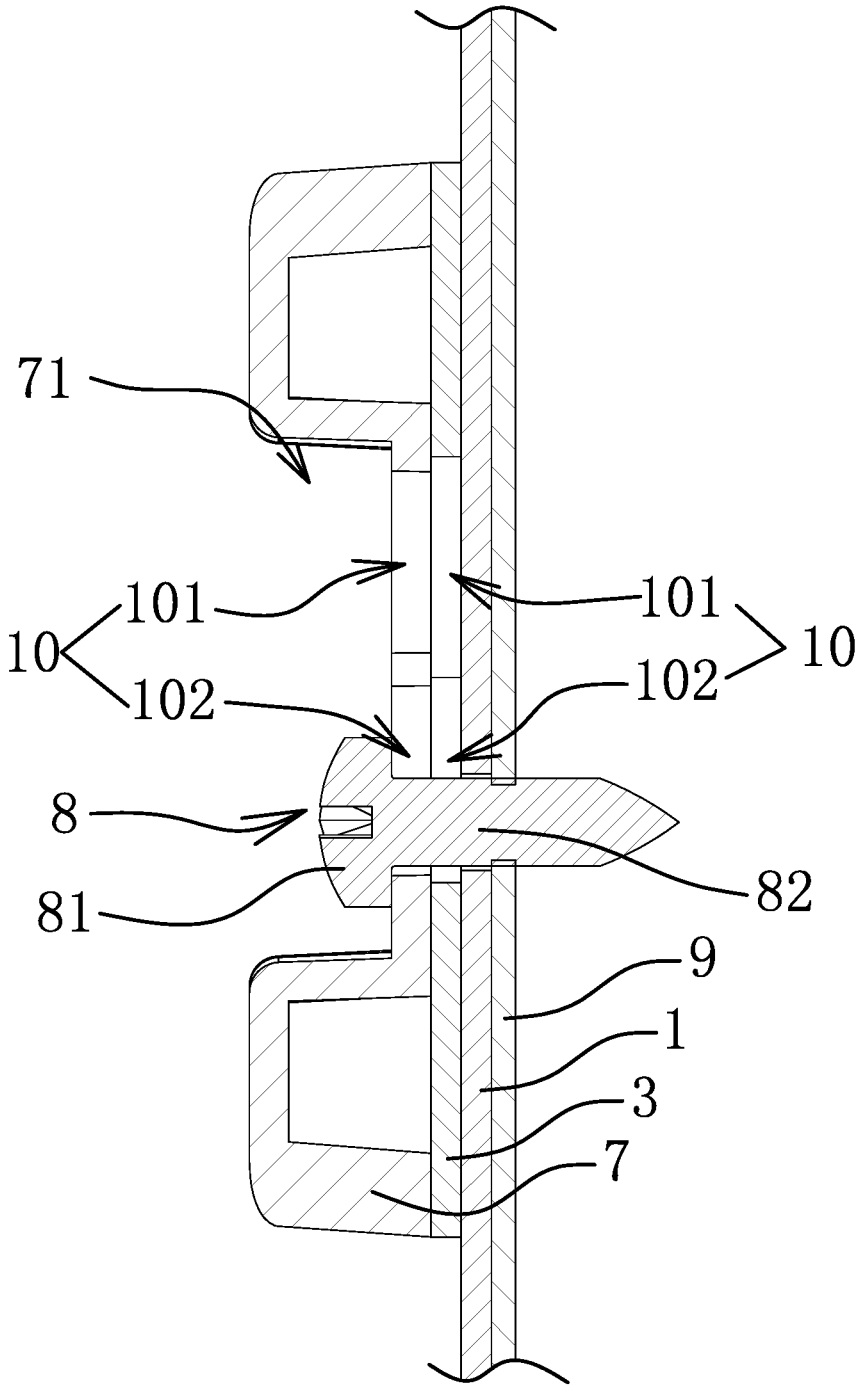
FIG. 8 is a sectional partial view along line D-D in FIG. 6.
Figure 9:
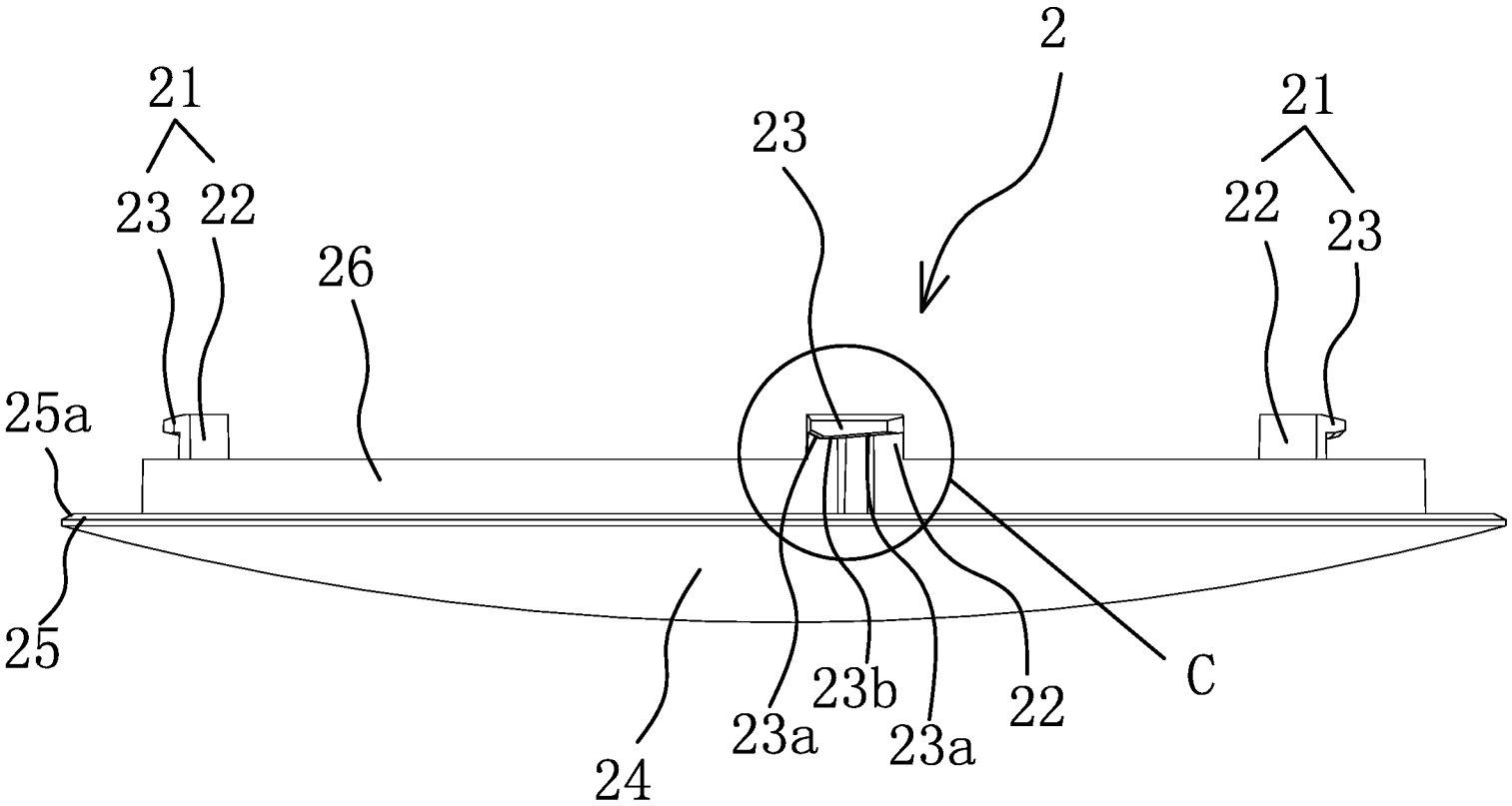
FIG. 9 is a side view of the transparent cover in the present invention.
Figure 10:
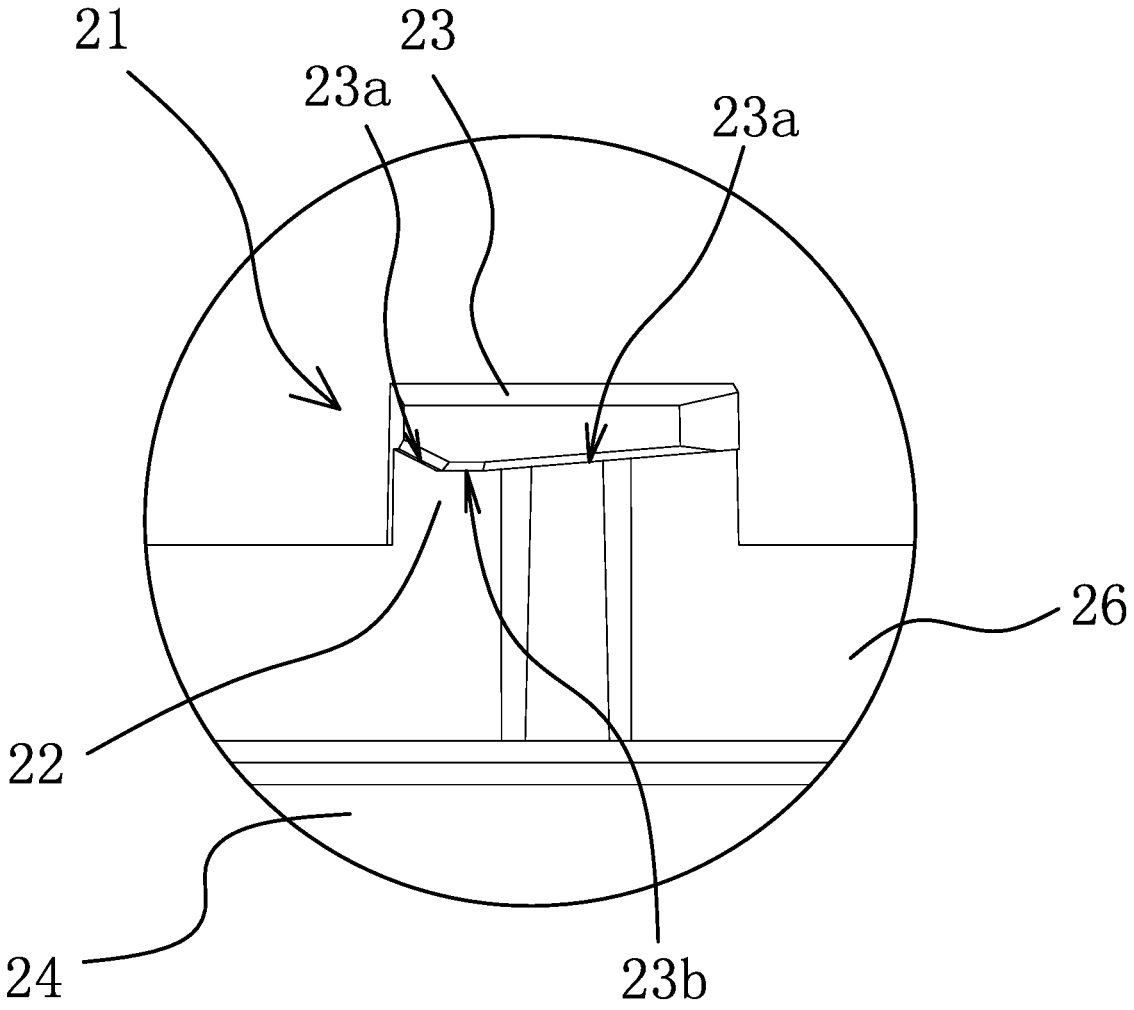
FIG. 10 is an enlarged partial view of an area C in FIG. 9.

As shown in FIGS. 6, 7, and 8, an inner transparent cover 7 covering the aluminum substrate module 3 is further connected to the top wall of the downlight housing 1. Both the inner transparent cover 7 and the aluminum substrate module 3 are provided with a plurality of elongated mounting holes 10, and the mounting holes 10 of the inner transparent cover 7 are exactly opposite to the mounting holes 10 of the aluminum substrate module 3. Each of the mounting holes 10 comprises circumferentially arranged a large aperture segment 101 and a small aperture segment 102, the large aperture segment 101 having an aperture diameter larger than that of the small aperture segment 102. The downlight further comprises a plurality of fasteners 8, which are screws or bolts. Each of the fasteners 8 comprises: a head 81 capable of passing through the corresponding large aperture segment 101 but impossible to pass through the corresponding small aperture segment 102, and a shank 82 capable of inserting into the corresponding small aperture segment 102. The head 81 of each of the fasteners 8 presses the inner transparent cover 7 and the aluminum substrate module 3 tightly against the top wall of the downlight housing 1 so as to attach both the inner transparent cover 7 and the aluminum substrate module 3 to the downlight housing 1. The aluminum substrate module 3 is provided thereon with a light source assembly 31 and a male adapter 34 electrically connected to the light source assembly 31 via a wire 33, and the male adapter 34 is disposed inside the downlight housing 1. The downlight housing 1 is connected with a connection base 9 provided on a top of the downlight housing 1, thus the connection base 9 is located above the downlight housing 1 and attached to a top surface of the downlight housing 1. The connection base 9 is fixed with the downlight housing 1 by screws. The screws are fixedly connected to the connection base 9 after passing through the top wall of the downlight housing 1. The connection base 9 has an electrically connected power cord 91 to which a female adapter 92 is connected, the female adapter 92 being capable of connecting to the male adapter 34 in a plug-in manner. The female adapter 92 is disposed inside the downlight housing 1, and the power cord 91 is connected to the female adapter 92 after passing through the top wall of the downlight housing 1. A bottom of the inner transparent cover 7 has inwardly recessed mounting notches 71 which are in one-to-one correspondence with the fasteners 8, and the head 81 of each of the fasteners 8 is provided in one of the corresponding mounting notches 71, respectively.

When the downlight is in need of maintenance, a user simply needs to remove the transparent cover 2 from the downlight housing 1 first, then disconnect the male adapter 34 from the female adapter 92, then detach and take out the inner transparent cover 7 and the aluminum substrate module 3, and after replacement of the aluminum substrate module 3 with a new one, reattach the inner transparent cover 7 and the new aluminum substrate module 3 to the top wall of the downlight housing 1, then reconnect the male adapter 34 with the female adapter 92, and finally reattach the transparent cover 2. In such maintenance process, there is no need to remove the whole downlight from ceiling, and the components of the downlight are convenient and easy to install and disassemble.

Embodiment II

This embodiment is basically the same as Embodiment I, with differences as follows.

Figure 11:
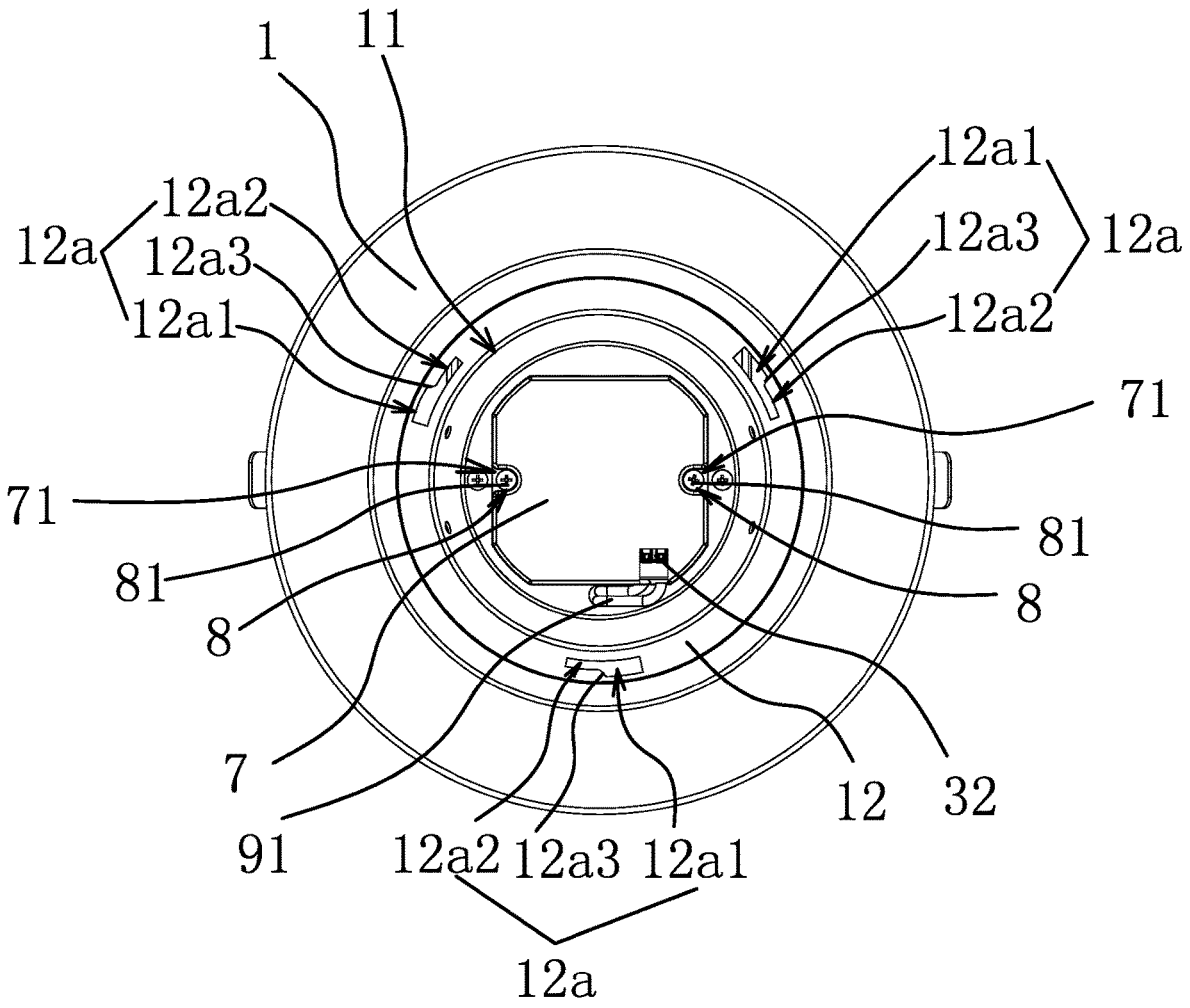
FIG. 11 is a bottom view of Embodiment II of the present invention, with the transparent cover removed.
Figure 12:
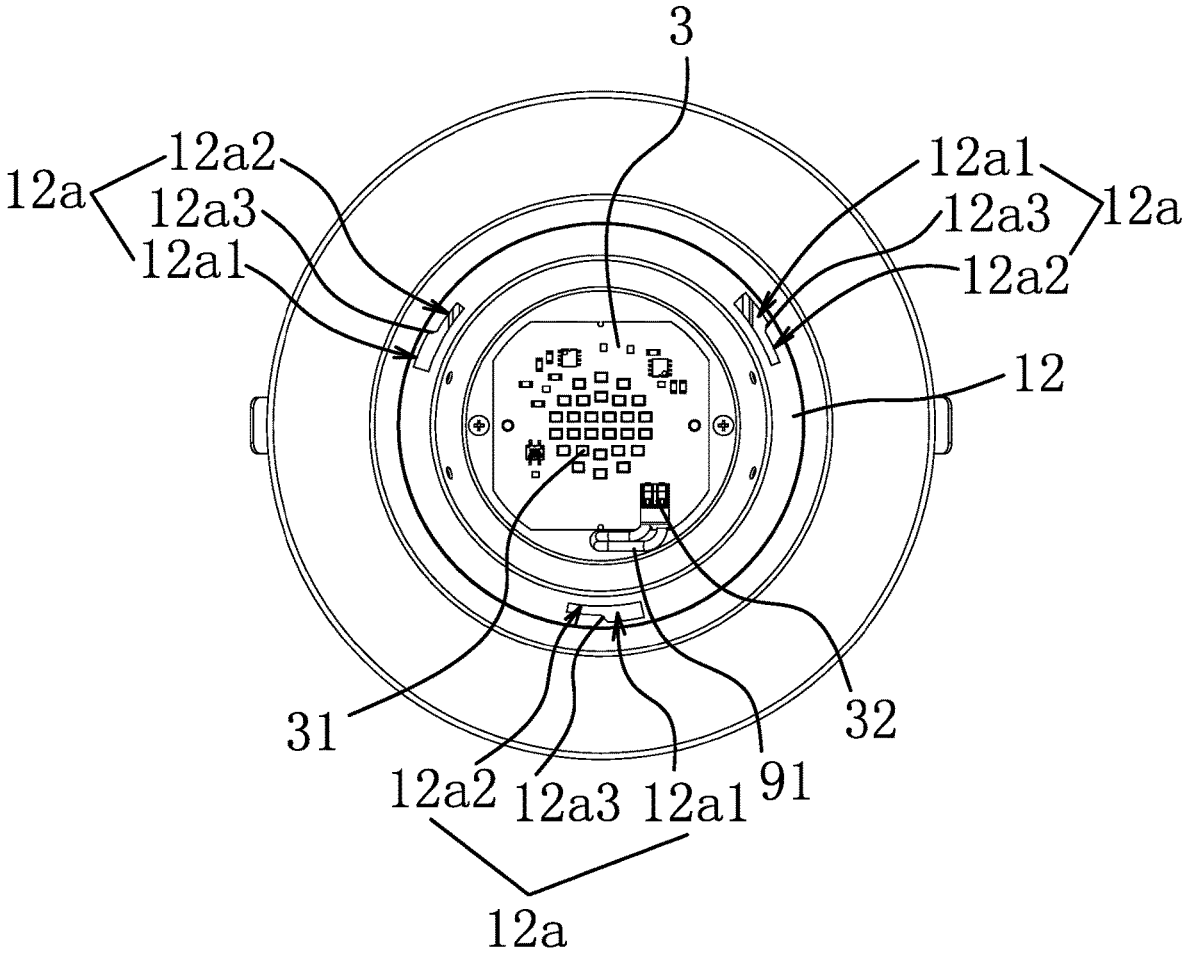
FIG. 12 is a bottom view of Embodiment II of the present invention, where both the transparent cover and the inner transparent cover are removed.

As shown in FIGS. 11 and 12, an inner transparent cover 7 covering the aluminum substrate module 3 is further connected to the top wall of the downlight housing 1, and by means of fasteners 8, the inner transparent cover 7 presses the aluminum substrate module 3 tightly against the top wall of the downlight housing 1, thus both the inner transparent cover 7 and the aluminum substrate module 3 are attached to the downlight housing 1 by the fasteners 8. A bottom of the inner transparent cover 7 has inwardly recessed mounting notches 71 which are in one-to-one correspondence with the fasteners 8, and the head 81 of each of the fasteners 8 is provided in one of the corresponding mounting notches 71, respectively. In addition, the guide surface **12*a*3 is formed to be angled inward from its one end away from the narrow slot segment 12*a*2 to the other end near the narrow slot segment 12*a*2**.

Using the inner transparent cover 7 to cover the aluminum substrate module 3 prevents external dust from affecting the brightness of the light source assembly 31 inside the aluminum substrate module 3; using the fasteners 8 to press the aluminum substrate module 3 tightly to the top wall of the downlight housing 1, so when the aluminum substrate module 3 is required to be removed, only the fasteners 8 need to be removed in order to take out both the inner transparent cover 7 and the aluminum substrate module 3 for replacement and maintenance of the aluminum substrate module 3. In this way, it realizes convenient maintenance or replacement of the aluminum substrate module 3 while ensuring proper use of the aluminum substrate module 3.

Embodiment III

This embodiment is basically the same as Embodiment I, with differences in that: the aluminum substrate module 3 is provided with a plurality of snap members on its outer lateral wall, and the downlight housing 1 is provided with a plurality of corresponding snap slots, so that the aluminum substrate module 3 can be attached to the downlight housing 1 by means of snap-fit of the snap members into the snap slots.

The snap-fit method makes it convenient to install and disassemble the aluminum substrate module 3, facilitating maintenance and replacement of the aluminum substrate module 3.

Embodiment IV

This embodiment is basically the same as Embodiment I, with differences as follows.

Figure 13:
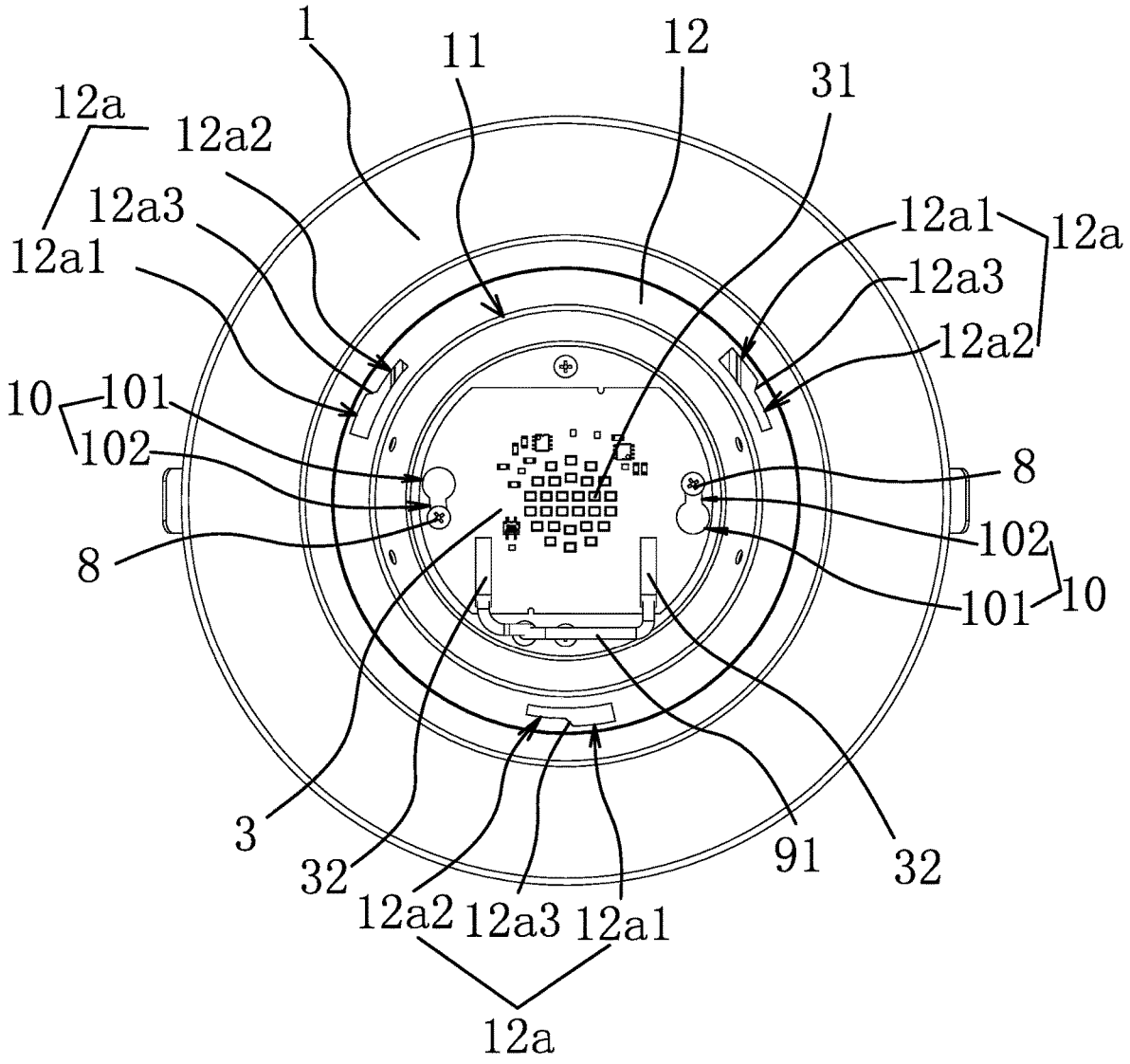
FIG. 13 is a bottom view of Embodiment IV of the present invention, where neither the transparent cover nor the inner transparent cover is installed.

As shown in FIG. 13, the aluminum substrate module 3 is provided thereon with a light source assembly 31 and a connector 32 electrically connected to the light source assembly 31, the downlight housing 1 is connected with a connection base 9 provided on the top of the downlight housing 1, and the connection base 9 has a power cord 91 detachably connected to the connector 32.

Detachably connecting the power cord 91 to the connector 32 facilitates quick connection and disconnection of the power cord 91, so that when the aluminum substrate module 3 is required to be removed for repair or replacement, a user just needs to directly disconnect the power cord 91 from the connector 32.

The specific embodiments described herein merely illustrate the concept of the present invention. A person skilled in the art of the present invention may make various modifications or supplementations to the specific embodiments described above or substitute them in a similar manner, without departing from the spirit of the present invention or going beyond the scope defined by the appended claims.

REFERENCED PARTS

1 Downlight Housing
11 Opening
12 Support Wall
**12*a*** Bayonet-Coupling Slot
**12*a*1** Wide slot segment
**12*a*2** Narrow slot segment
**12*a*3** Guide Surface
2 Transparent Cover
21 Bayonet-Coupling Protrusion
22 Sliding Portion
23 Limit Portion
**23*a*** Avoidance Surface
**23*b*** Limit Surface
24 Cover body
25 Shoulder
**25*a*** Bevel Face
26 Heat Sink Rim
3 Aluminum Substrate Module
31 Light Source Assembly
32 Connector
33 Wire
34 Male Adapter
4 Heat Dissipation Gap
5 Heat Dissipation Space
6 Working Space
7 Inner Transparent Cover
71 Mounting Notch
8 Fastener
81 Head
82 Shank
9 Connection Base
91 Power Cord
92 Female Adapter
10 Mounting hole
101 Large aperture segment
102 Small aperture segment

The invention claimed is:

1. A downlight, comprising:

a downlight housing with a downward-facing opening;

an aluminum substrate module disposed inside the downlight housing and detachably connected to a top wall of the downlight housing; and a transparent cover disposed at the opening inside the downlight housing and below the aluminum substrate module;

wherein the transparent cover has a plurality of bayonet-coupling protrusions protruding vertically, the downlight housing has a horizontal ring-shaped support wall at a middle part of the downlight housing, the support wall is provided thereon with bayonet-coupling slots in one-to-one correspondence with the bayonet-coupling protrusions, each of the bayonet-coupling slots comprises circumferentially arranged a wide slot segment and a narrow slot segment, the wide slot segment having a width along a radial direction of the support wall, the width of the wide slot segment wider than a width of the narrow slot segment, and each of the bayonet-coupling protrusions is capable of inserting vertically into the wide slot segment of one of the corresponding bayonet-coupling slots and sliding circumferentially along one of the corresponding bayonet-coupling slots to the narrow slot segment where one of the corresponding bayonet-coupling protrusions abuts with its lateral lower surface against the support wall.

2. The downlight as claimed in claim 1, wherein each of the bayonet-coupling protrusions comprises a sliding portion capable of sliding in one of the bayonet-coupling slots and a horizontal limit portion capable of abutting against the support wall, the limit portion has a lower end surface comprising an upwardly inclined avoidance surface and a limit surface capable of abutting against the support wall, with the limit surface being jointed to a lower end of the avoidance surface, and a heat-dissipation gap is formed between the avoidance surface and the support wall when the limit surface abuts against the support wall.

3. The downlight as claimed in claim 1, wherein a slot wall of each of the bayonet-coupling slots has a guide surface connecting a slot wall of the wide slot segment and a slot wall of the narrow slot segment, and the guide surface is formed to be angled inward from its one end away from the narrow slot segment to the other end near the narrow slot segment.

4. The downlight as claimed in claim 1, wherein a slot wall of each of the bayonet-coupling slots has a guide surface connecting a slot wall of the wide slot segment and a slot wall of the narrow slot segment, and the guide surface is convex-inwardly curved.

5. The downlight as claimed in claim 1, wherein the transparent cover comprises a curved cover body, an shoulder extending on an outer edge of the cover body and capable of abutting against the downlight housing, a heat sink rim formed by vertical projection of the cover body and opposite a lateral inner side of the support wall, and the bayonet-coupling protrusions provided at an upper end of the heat sink rim, a heat-dissipation space is enclosed and formed by the heat sink rim, the shoulder and the downlight housing together and communicatively connected with all the bayonet-coupling slots.

6. The downlight as claimed in claim 5, wherein the heat sink rim is ring-shaped so that a working space is enclosed and formed by the cover body, the heat sink rim and the downlight housing together and separated from the heat-dissipation space by the heat sink rim.

7. The downlight as claimed in claim 5, wherein the shoulder is ring-shaped and provided on its outer side with a bevel face that slopes outward in an up-to-down direction.

8. The downlight as claimed in claim 1, wherein an inner transparent cover covering the aluminum substrate module is further connected to the top wall of the downlight housing, both the inner transparent cover and the aluminum substrate module are provided with a plurality of elongated mounting holes, the mounting holes of the inner transparent cover are exactly opposite to the mounting holes of the aluminum substrate module, each of the mounting holes comprises circumferentially arranged a large aperture segment and a small aperture segment, the large aperture segment having an aperture diameter larger than that of the small aperture segment, the downlight further comprises a plurality of fasteners, each of the fasteners comprises a head capable of passing through the corresponding large aperture segment and a shank capable of inserting into the corresponding small aperture segment, the head of each of the fasteners press the inner transparent cover and the aluminum substrate module tightly against the top wall of the downlight housing so as to attach both the inner transparent cover and the aluminum substrate module to the downlight housing.

9. The downlight as claimed in claim 8, wherein a bottom of the inner transparent cover has inwardly recessed mounting notches which are in one-to-one correspondence with the fasteners, and the head of each of the fasteners is provided in one of the corresponding mounting notches, respectively.

10. The downlight as claimed in claim 8, wherein the aluminum substrate module is provided thereon with a light source assembly and a male adapter electrically connected to the light source assembly via a wire, the downlight housing is connected with a connection base provided on a top of the downlight housing, the connection base has an electrically connected power cord to which a female adapter is connected, the female adapter being capable of connecting to the male adapter in a plug-in manner.

11. The downlight as claimed in claim 1, wherein an inner transparent cover covering the aluminum substrate module is further connected to the top wall of the downlight housing, and the downlight further comprises a plurality of fasteners by means of which the inner transparent cover presses the aluminum substrate module tightly against the top wall of the downlight housing thus attaching the aluminum substrate module to the downlight housing.

* * * * *